US009611630B2

(12) United States Patent
Danhi

(10) Patent No.: US 9,611,630 B2
(45) Date of Patent: Apr. 4, 2017

(54) DRAIN CATCH WITH CROSS BARS REPAIR INSERT

(71) Applicant: Martin G. Danhi, Hollywood, FL (US)

(72) Inventor: Martin G. Danhi, Hollywood, FL (US)

( * ) Notice: Subject to any disclaimer, the term of this patent is extended or adjusted under 35 U.S.C. 154(b) by 129 days.

(21) Appl. No.: 14/690,213

(22) Filed: Apr. 17, 2015

(65) Prior Publication Data

US 2015/0299993 A1 Oct. 22, 2015

Related U.S. Application Data

(60) Provisional application No. 61/980,722, filed on Apr. 17, 2014.

(51) Int. Cl.
*E03C 1/22* (2006.01)
*E03C 1/26* (2006.01)

(52) U.S. Cl.
CPC . *E03C 1/22* (2013.01); *E03C 1/26* (2013.01)

(58) Field of Classification Search
CPC ..... E03C 1/22; E03C 1/26; E03C 1/23; E03C 1/232; E03C 1/262; E03C 1/266; E03C 1/2665
USPC ... 4/286, 287, 290, 291, 293–295, 679, 680, 4/682, 686, 688, 292
See application file for complete search history.

(56) References Cited

U.S. PATENT DOCUMENTS 605,813 A * 6/1898 Chase ..... E03C 1/264 4/292
1,009,862 A * 11/1911 Ruckstinat ..... E03C 1/22 285/206
2,145,759 A * 1/1939 Fellows ..... B60K 15/0403 210/172.6
2,167,372 A * 7/1939 Recker ..... E03C 1/22 29/890.14
2,385,425 A * 9/1945 Slezak ..... E03C 1/22 137/247.49
D167,285 S 7/1952 Schmid
2,739,317 A 3/1956 Abresch
2,905,951 A * 9/1959 Weddendorf, Jr. ..... E03C 1/262 285/206
3,027,569 A 4/1962 Lantz et al.
3,212,416 A * 10/1965 Boersma ..... E03F 5/06 210/163
3,588,928 A 6/1971 Hiertz
(Continued)

OTHER PUBLICATIONS http://www.searspartsdirect.com/partsdirect/part-model/All-brands-Parts/Sink-Parts/Model-SINKSTRAINER/0025/0914900/00056656/00012?blt=06&prst=&shdMod.
http://www.deltafaucet.com/kitchen/details/72011-ss.html.
http://www.lowes.com/pd_30505-1366-89049_0_?productId=3380214.

*Primary Examiner* — J. Casimer Jacyna
(74) *Attorney, Agent, or Firm* — Robert M. Schwartz

(57) ABSTRACT

A replacement drain catch with internal cross bars to replace defective, damaged or missing pop-up stoppers or other missing partially occluding drain protective devices used in drains for sinks or tubs. The drain catch has a flange which sits atop the plumbing drain of the sink, and includes a pair of perpendicular bars to catch objects that may fall within the plumbing drain or that may be in the fluid passing through the drain catch. The bars are attached to a cylindrical wall. A plurality of deformable seating elements are located about the cylindrical wall to adjust the fit of the drain catch within the plumbing drain and a plurality of lift openings within the cylindrical wall are provided to help remove the drain catch from the plumbing drain.

3 Claims, 9 Drawing Sheets

(56) References Cited

U.S. PATENT DOCUMENTS

| | | | | |
|---|---|---|---|---|
| 3,596,294 | A | 8/1971 | Hoffman | |
| 4,232,407 | A | 11/1980 | Williams | |
| 4,257,892 | A * | 3/1981 | Boersma | E03F 5/0407 210/163 |
| 5,265,281 | A * | 11/1993 | McAlpine | E03C 1/262 4/287 |
| 7,150,576 | B1 | 12/2006 | Kambeyanda | |
| D553,225 | S | 10/2007 | Wolf | |
| D606,174 | S | 12/2009 | Martin | |
| 7,704,386 | B2 | 4/2010 | Ventura | |
| 2010/0206969 | A1* | 8/2010 | Strong | E03C 1/26 241/101.01 |
| 2013/0125299 | A1 | 5/2013 | Tong | |

* cited by examiner

DRAIN CATCH WITH CROSS BARS REPAIR INSERT

PRIORITY DOCUMENTS

This application claims the benefit of U.S. Provisional Application Ser. No. 61/980,722, filed on Apr. 17, 2014, entitled "Drain Cross Bar Repair Insert" the prior application is herewith incorporated by reference in its entirety.

BACKGROUND OF THE INVENTION

Bath tubs, sinks, and many other fluid holding platforms almost always use some device or mechanism which is incorporated into their drains that limit the size of the effective drain opening so that larger objects which could potentially pass through the drain opening and clog the plumbing are prevented from going down. The Pop-up stopper is one such commonly used device. When its open, or in the up, position water may pass through freely but because of its design, shape and placement in the drain opening it effectively limits the size of the drain opening to keep larger objects from falling through. The pop up stopper has a mechanical connection to an actuator rod, which would cause the stopper to move to an open position, permitting water to drain from the platform, and to a closed position, holding the water in the sink, tub or other water holding platform, hereinafter collectively but not limited to sink. When the stopper is in the closed position, it forms a seal with a flange of the plumbing drain of the sink preventing the water from draining from the basin of the sink. It is known that the pop up stopper in time may fail, become damaged, lost, or that the sink basin may not include a stopper at all. Some sinks and tubs may have a different type of stopper or no stopper at all. These sinks may have been designed with an element which is located further down in the drain which passes in front of the water flow and reduces the size of the effective opening to prevent larger objects from going down past it and potentially clogging the plumbing. These elements can also break, rot or be missing altogether. Depending on the specific sink or other water holding platform, it may be difficult to replace the pop up stopper, or other damaged or missing device designed to prevent larger objects from passing through and causing a clog, and professional repair services are expensive. What is required is an inexpensive repair device which may be easily placed in the plumbing drain, that can adjust to the inside diameter of the plumbing drain of the sink, is easily removable, and would restore the original look and function of the drain, including prevention of the loss of items down the drain to the trap, while still providing a large, unrestrictive opening that would not trap hair or otherwise restrict water flow. Specifically it is a goal of the present invention to maximize the unrestricted area of fluid flow through the inner channel and minimize the surface area of any occluding objects such as the cross bars in the present invention. Preferably a ratio of the top surface area of the cross bars, the occlusions, to the open area of the inner channel being less than 30 percent and an optimal ratio of less than 25 percent and a preferred range between 15 to 20 percent depending on the area of the inner channel.

BRIEF DESCRIPTION OF THE INVENTION

The invention is a drain catch cross bar repair insert for receiving water or fluid and discharging the fluid into the plumbing drain, which includes a cylindrical element with a circular top flange connected to a cylindrical wall. At or near the bottom of the cylindrical wall are two cross-bars or other occlusions to prevent items from further travel with or without the fluid into the plumbing drain. The two cross bars are connected at or near the bottom of the cylindrical walls in a perpendicular relationship forming a shape similar to a letter "X": and are shown in the drawings. After the removal of the damaged or non-functioning stopper from the plumbing drain of the sink, the invention may be simply inserted into the plumbing drain of the sink, bathtub or other water holding platform with a drain preferably with a friction fit. Once the drain catch is installed, water may freely drain through the drain catch, while objects larger than the openings formed by the cross bar insert will be prevented from going down the drain because of the restriction at the end or within the cylindrical wall of the present invention. When desired, a rubber stopper may be externally placed inside or on the top of the open end of the invention, to prevent fluid from flowing through the drain catch and permitting the sink or bath to be filled when desired.

Beneath the circular top flange close to the top of the cylindrical wall are about six horizontal ovoid openings which are generally spaced equally apart. These openings are provided to permit a regular head screwdriver, or other lever to be inserted there through, and by pushing the lever downward, the drain catch is forced upward, to allow the removal of the invention from the drain. The invention removal device is not limited to a regular head screwdriver, any device or lever which can act as a pry bar could be employed. The device may also be removed using other methods such as a hook shaped tool to pull the drain catch upward from the plumbing drain for removal.

In the middle region of the cylindrical wall are about six seating elements which are generally spaced equally apart. Each of the seating elements are identical and include a right side crescent opening, a left side crescent opening, and the seating element intermediate the right side crescent opening and the left side crescent opening. Both the right and left side crescent openings are vertical and are about the same height as the seating elements. Although other arrangements of openings and seating elements can be constructed. Each of the seating elements are designed to be bent outwardly and displaced away from the extension face of the cylindrical wall toward the inner surface of the plumbing drain. This may be performed by a screwdriver or other lever or prying instrument. This effectively increases the diameter of the cylindrical sidewall and permits the invention to fit snugly into a plumbing drain against the inner wall of the plumbing drain.

At or near the bottom of the cylindrical wall is a cross bar or other occlusion. These cross bars are the length of the inner diameter of the circle formed by the cylindrical wall. They are attached to the internal surface of the cylindrical wall, and preferably meet in the inner channel formed by the cylindrical wall in a perpendicular fashion forming a barrier or restriction to prevent larger objects from falling in and proceeding through into the plumbing drain to clog the drain.

The invention may be manufactured from, but it not limited to 0.020 gauge stainless steel. Stainless steel prevents any part of the invention from rusting. Stamping manufacturing techniques may also be employed.

In summary the invention is a drain catch for receiving fluid in a plumbing drain, having a drain body with a cylindrical wall constructed and arranged for having a fluid flow there through, the drain body having a first end and a second end, the cylindrical wall having an internal surface defining an inner channel and an external surface, the first end of the drain body having a flange extending from the cylindrical wall for supporting the drain body on a plumbing drain, and the second end of the drain body having one or more elongated bars extending from the internal surface of the cylindrical wall into the inner channel.

Further, the drain catch includes a first bar and a second bar that intersect one another.

Additionally, the drain catch includes a first bar that extends from a first point on the internal surface to a second point on the internal surface and a second bar extends from a third point on the internal surface to a fourth point on the internal surface.

Further, the first the bar and the second bar may intersect one another and can intersect at their respective midpoints.

Additionally the drain catch can include at least one seating element defined by the cylindrical wall and configured for engaging an inner diameter of a plumbing drain and holding the drain catch in place. The at least one seating element is defined by one or more cutouts within the cylindrical wall adjacent the at least one seating element.

Further, the at least one seating element is defined by a first cutout adjacent one side of the at least one seating element and a second cutout adjacent a second side of the at least one seating element, and the first cutout and the second cutout are congruent.

Additionally, at least one seating element extends in a direction from the first end to the second end.

Additionally, the at least one seating element may be displaced beyond the external surface.

Further, the at least one seating element is manually displaceable into a position displaced beyond the external surface.

Additionally, the drain catch includes a plurality of lift opening within the cylindrical wall spaced apart from one another in close proximity to the first end of the cylindrical wall. Additionally, the lift openings can be generally oval in shape.

Further, the edges of the bars have flanges protruding therefrom to provide for a smoother flow and original appearance.

The invention also includes a method for securing the drain catch into a plumbing drain snugly after determining if the outside diameter of the cylindrical wall is less than the inside diameter of the plumbing drain. Then one or more of the seating elements may be displaced beyond the external surface, and then inserting the drain catch into the plumbing drain such that one or more of the seating elements are in contact with the inner surface of the plumbing drain.

Additionally, the method for removing the drain catch includes inserting an end of a lever into one of the lift openings, and rotating the lever to lift the drain catch from the plumbing drain.

Further, the elongated bars have a top surface orientated toward the top of the drain catch, and the ratio of the top surface area of the elongated bars in comparison to the inner channel area is less than 30 percent, and the ratio is preferably less than 25 percent.

DETAILED DESCRIPTION OF THE PREFERRED EMBODIMENT

Figure 1:
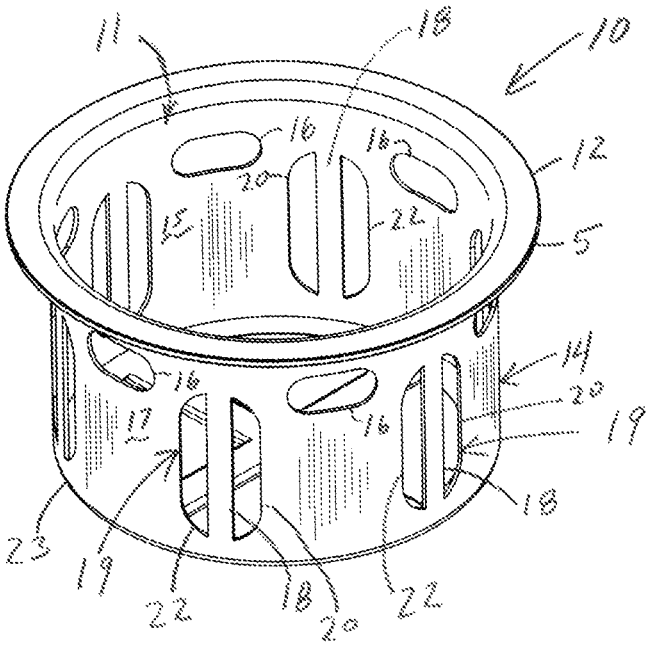
FIG. 1 is a front perspective view of the drain catch.

Referring now specifically to FIGS. 1, 4, 5 and 6, a variety of views of the drain catch 10 is shown. Drain catch 10 has a drain body having a cylindrical wall 14, with an open end 11 and an open second end 13. Cylindrical wall 14 has an internal surface 15 and an external surface 17. The internal surface 15 defines an inner channel for receiving a fluid. The fluid contained within for example sink 74 which drains through a first end 11 of drain catch 10 and through a second end 13 of drain catch 10 into a plumbing drain 76. Plumbing drain 76 has a sealing flange 68 to engage sink 74 and to receive drain catch 10. A flange 12 extends outward from external surface 17 of cylindrical wall 14. The flange 12 has a perimeter edge 5. The flange 12 is adapted to be supported by the flange 68 of the plumbing drain 76 in sink 74 (best seen in FIGS. 10 and 11). A small curved portion 13 has a radius where flange 12 connects to cylindrical wall 14 and prevents a sharp edge on the inner portion of drain catch 10. In some embodiments of the invention the flange 12 may be directly connected to the vertical cylindrical wall 14 without a radius. When in place, drain catch 10 allows water or other fluid to flow through, drain catch 10. Drain catch 10 includes a restriction within the inner channel of cylindrical wall 14 to prevent objects or items from moving into or passing through plumbing drain 76.

Figure 9:
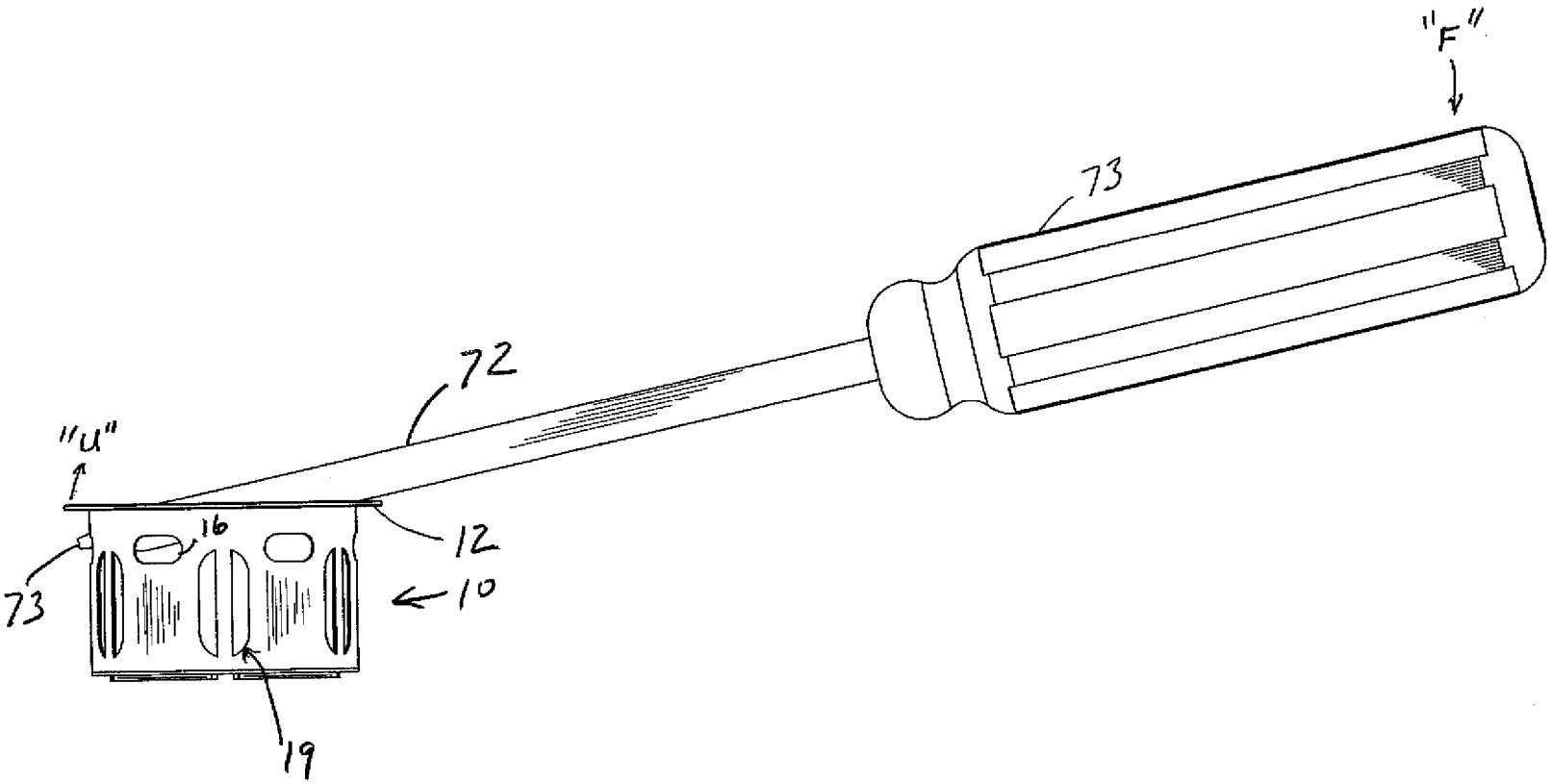
FIG. 9 is a view showing a screwdriver using the tip and a leverage point to remove the catch from a plumbing drain.

On the upper portion of the cylindrical wall 14, below the flange 12, are six horizontal equally spaced ovoid cutouts 16. The ovoid cutouts 16 pass through the cylindrical wall 14. When it is necessary to remove the drain catch 10 from the plumbing drain 76. A screwdriver 72, lever or other prying instrument would be used to pry the drain catch 10 out of the plumbing drain 76. This is best shown in FIG. 9 where a downward force 'F' on the handle 73 of screwdriver 12 would rotate drain catch 10 to lift an edge 5 of flange 12 above flange 68 in order to remove drain catch 10. Although six ovoid cutouts 16 are shown, it is to be understood that less or more ovoid cutouts 16 may be employed if desired.

On the middle portion of the cylindrical wall 14 are six seating elements 19 which include a vertical seating element 18 intermediate a right side crescent shaped cutout 20 and a left side crescent shaped cutout 22. A screwdriver 72 or other prying instrument may be placed through either the right side crescent cutout 20 or the left side crescent cutout 22, slid under the seating element 18 to displace the seating element 18 in an outward fashion beyond the external surface 17 of cylindrical wall 14. This could be performed on one or more or all six of the seating elements 18, giving the drain catch 10 a greater diameter about midway down the cylindrical wall 14 which would permit and be able to size the drain catch 10 to fit snugly, with a friction fit, within the inner diameter of plumbing drain 76 and against internal surface 77 of plumbing drain 76. Each seating element 18 is displaceable outwardly and beyond the external surface 17 a variety of distances, which allows drain catch 10 to be sized to fit snugly within a plumbing drain 76, no matter what the actual size or inner diameter of plumbing drain 76. Although six sizing elements 19 are shown it is to be understood that less or more sizing elements 19 may be employed if desired.

The drain catch 10 may include a bottom flange 23 which is connected to and forms a part of the internal surface 15 of cylindrical wall 14. Drain catch 10 preferably includes an elongated first cross bar 90 and an elongated second cross bar 92. Other restriction elements or other arrangements of cross bars 90 and 92 can be arranged to create a restriction within the inner channel of cylindrical wall 14, to prevent objects from travel or passing through drain catch 10 into the plumbing drain 76.

Figure 2:
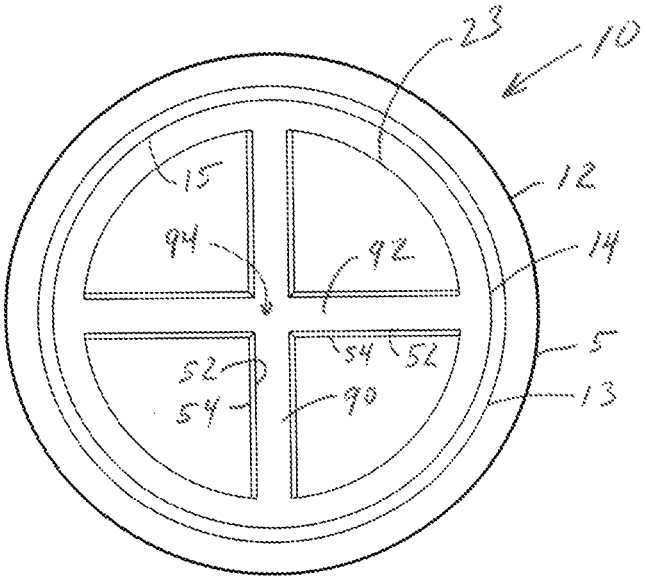
FIG. 2 is a top plan view of the catch.
Figure 12:
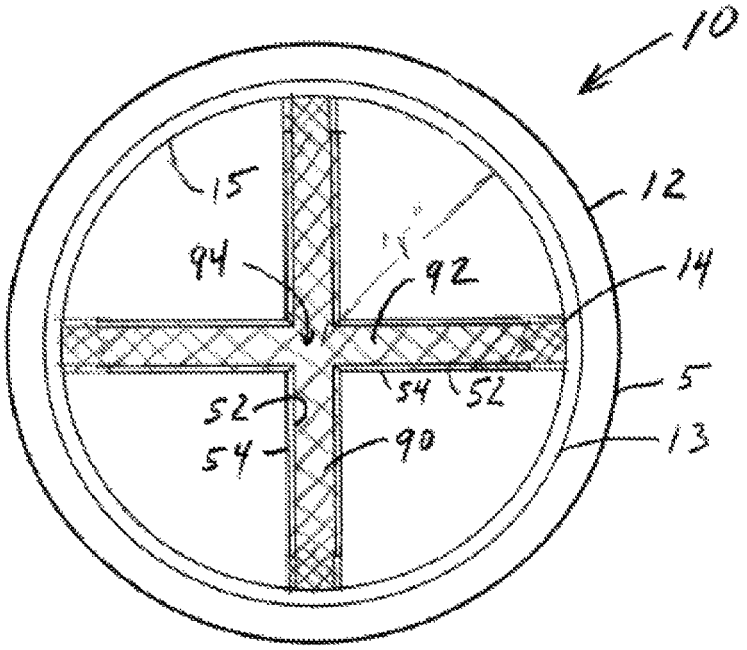
FIG. 12 is a bottom view, similar to FIG. 2 showing in cross-hatching the occluded area of the elongated bars, in comparison to the non-occluded area of the inner channel and shown without a bottom flange 23.

Referring now to FIG. 2, a top plan view of the drain catch 10 is shown. The perimeter 5 of flange 12 is circular. Flange 12 is horizontal until flange 12 intersects a small downwardly curved element 13 which in turn is connected to the vertical cylindrical wall 14. Within the inner channel of cylindrical wall 14 of the drain catch 10 are a first elongated cross bar 90 and a second elongated cross bar 92 connected together perpendicularly in the bottom center 94. Both the first cross bar 90 and the second cross-bar 92 extend radially from the bottom center 94 where they are connected to the bottom flange 23 or the internal surface 15 of cylindrical wall 14. This internal surface 15 defines an inner channel of cylindrical wall 14. The occluding elements, cross bars 90 and 92, are preferably constructed and arranged to be perpendicular to one another, to prevent larger objects from passing through the drain, but not prevent smaller objects from clogging the drain catch 10. For example hair can pass through, otherwise hair would eventually clog the openings created by the occluding elements, bars 90 and 92. Thus in a preferred embodiment the elongated bars 90 and 92 have a small occluding surface area in comparison to the overall area of the inner channel thus maximizing the open area within the inner channel to allow increased or maximum fluid flow through the drain catch. As used herein the surface area of the elongated bars 90 and 92 would be defined as the area on the upper portion of each bar 90 and 92 that obstruct any fluid flow through drain catch 10. This surface area for each bar 90 and 92 is marked in FIG. 12 with cross-hatch lines, which shows the top surface area of each bar 90 and 92, where the top is oriented toward the top of the drain catch 10 where the fluid enters. In a preferred embodiment this occluded area would be as small as possible in comparison to the overall area of the open inner channel area, where the area of the inner channel would be calculated as $\pi r^2$ and where "r" is the radius of the inner channel. See FIG. 12 showing the radius "r".

The first cross bar 90 has a curved radius edge portion 52 which forms a flange at 54. The second cross bar 92 also has a curved radius edge portion 52 which forms a flange 54. The bottoms 56 of flanges 54 can be seen in FIG. 3. The cross bars 90 and 92 allow water or fluid to pass through the cylindrical sidewall 14 but restrict or prevent objects and/or items from passing through the drain catch 10 and into the plumbing drain 76.

Figure 3:
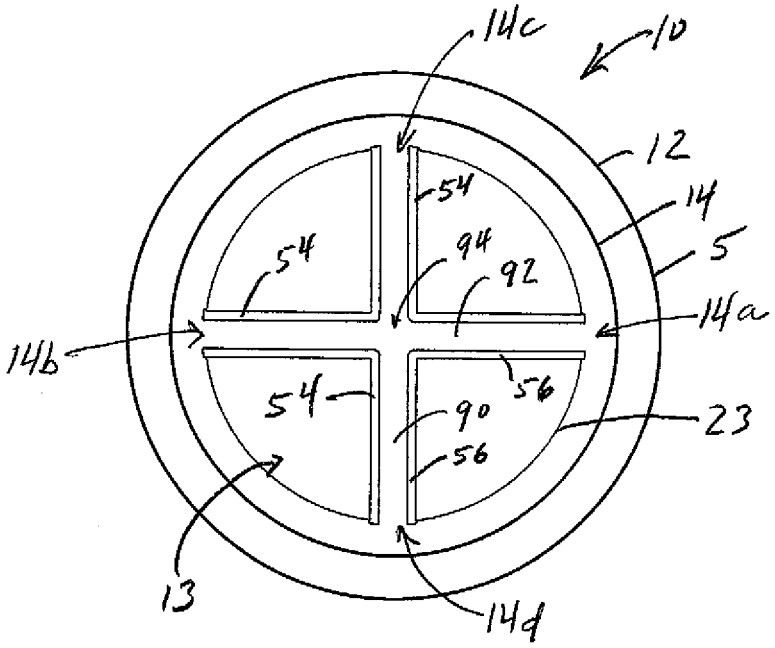
FIG. 3 is a bottom view of the drain catch.
Figure 4:
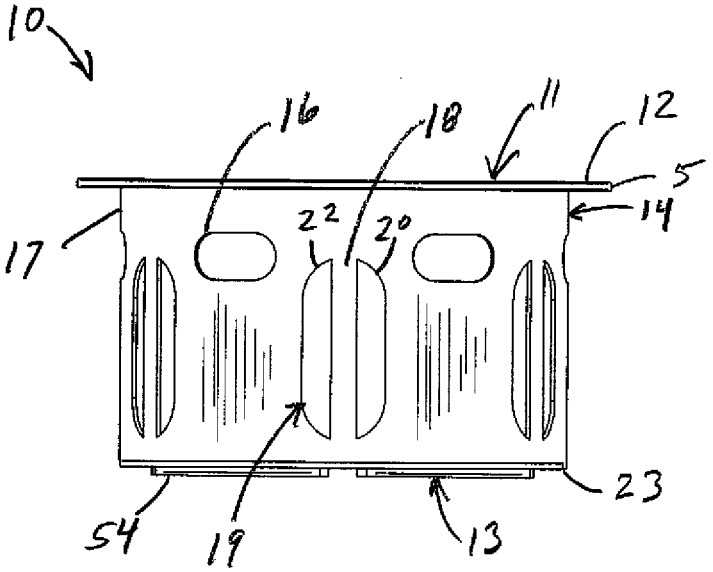
FIG. 4 is a left side view of the drain catch.
Figure 5:
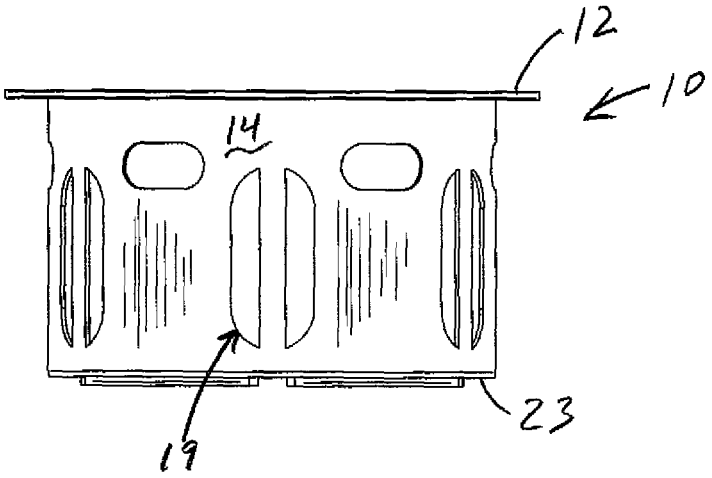
FIG. 5 is a right side view of the drain catch.

Referring now to FIG. 3 a bottom view of the drain catch 10 is shown. The perimeter 5 of flange 12 is circular. At the bottom of the drain catch 10 are elongated first cross bar 90 and an elongated second cross bar 92 connected together and which are perpendicularly to one another in the bottom center 94. First cross bar 90 extends from a first point 14 on internal surface 15 to a second point 14*b* on internal surface 15. Likewise second cross-bar 92 extends from a third point 14*c* on internal surface 15 to a fourth point 14*d* on internal surface 15. First bar 90 and second bar 92 intersect at bottom center 94. The bottom edges 56 of flanges 54 can be seen in FIG. 3.

Figure 7:
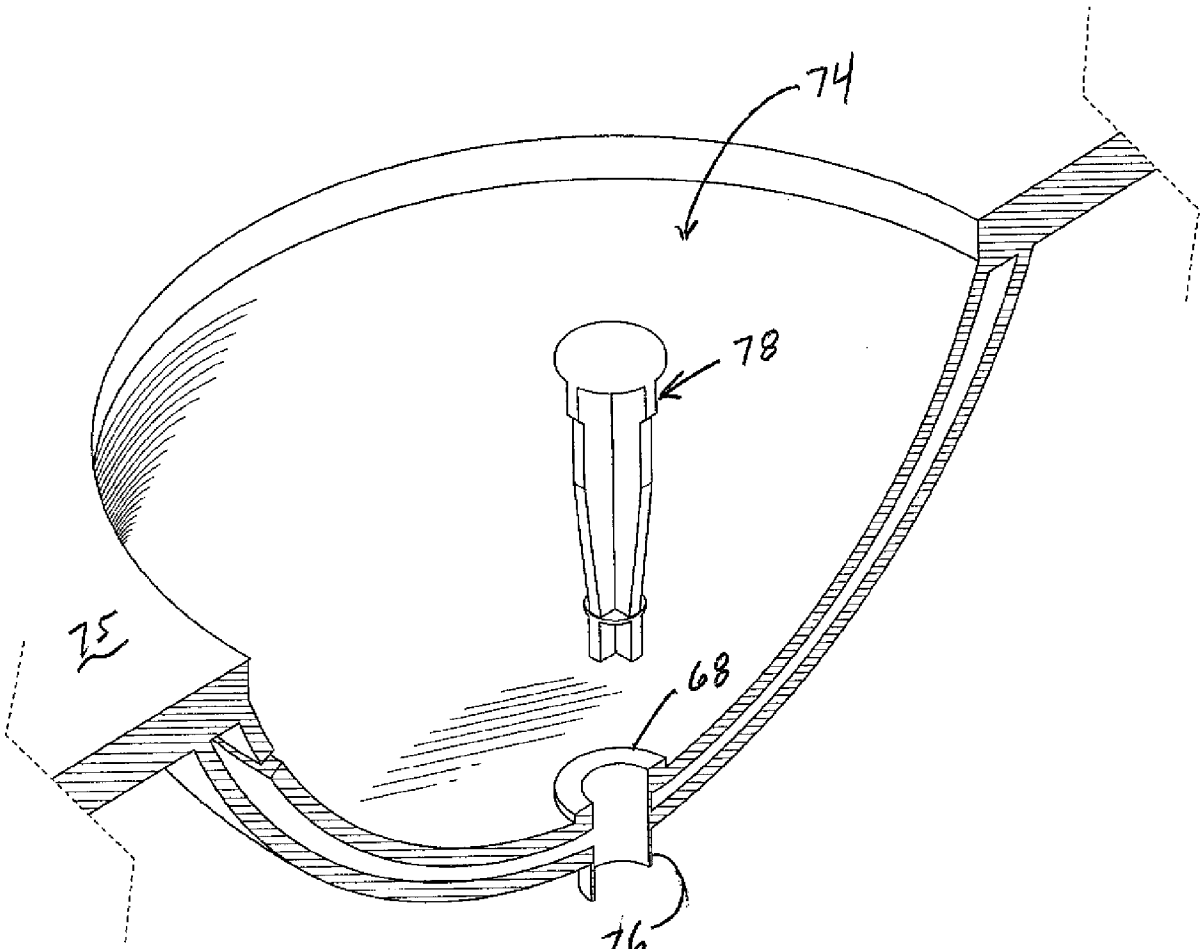
FIG. 7 is a cut away view of a sink showing a prior art drain stopper being removed from the plumbing drain.

Referring now specifically to FIG. 7, a sink 74 mounted on and surrounded by a sink table 75 is shown. At the bottom of the sink 74 is the plumbing drain 76 having a sink sealing flange 68. A pop-up stopper 78 is shown elevated above the sealing flange 68. The pop up stopper 78 must be removed prior to the insertion of the drain catch 10. The drain catch 10 is employed when the conventional drain stopper 78 fails or is damaged. The drain catch 10 may also be employed in the plumbing drain 76 prior to the failure of the pop up stopper 78 if so desired. The pop up stopper 78 may be disposed of appropriately.

Figure 8:
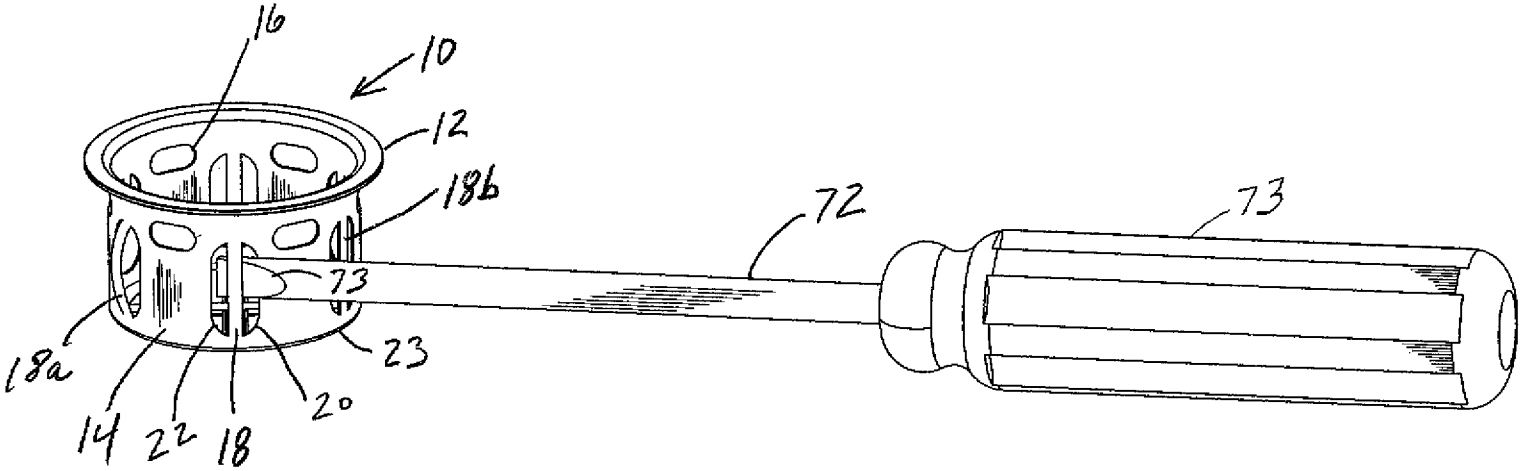
FIG. 8 is a view showing the screwdriver using the tip to displace a vertical bar, the seating element, away from the external surface of the cylindrical wall.

Referring now specifically to FIG. 8, the method of prying out the sizing element 19 is shown. The screwdriver 72 (or other lever or prying device) slides blade 73 under the deformable seating element 18 through the (in this case) the right side crescent shaped cutout 20. By manipulating the screwdriver 72, the deformable seating element 18 is displaced outwardly from the external surface 17 of cylindrical wall 14. Alternatively, the blade 73 of screwdriver 72 may slide under the deformable seating element 18 through the left side crescent shaped cutout 22. By manipulating the screwdriver 72, the deformable seating element 18 is displaced outwardly. This outward deformation can be seen in FIG. 8 where a deformed seating element 18*a* is shown displaced away from external surface 17 of cylindrical wall 14.

Figure 6:
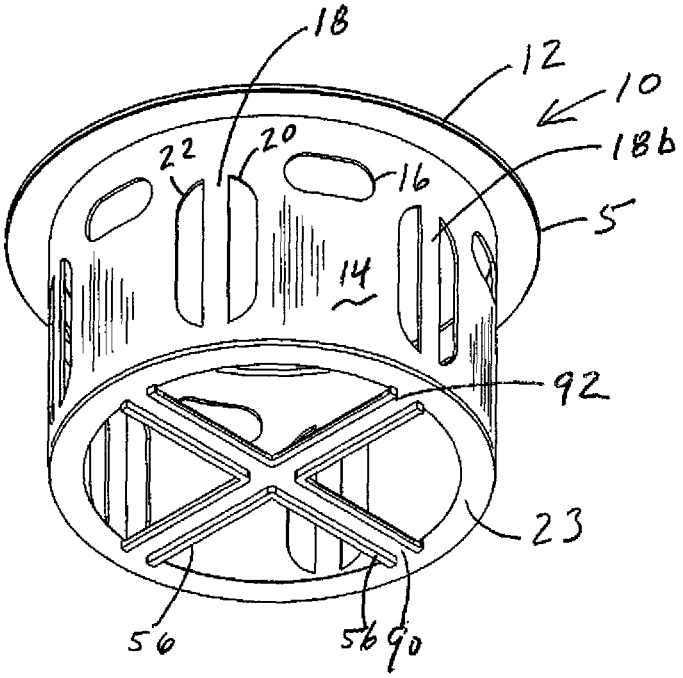
FIG. 6 is a bottom perspective view of the drain catch.

Referring now to FIG. 8 a seating element 18 marked as 18*a* is shown in a deployed position, and seating element 18 marked as 18*b* is shown in a non-deployed position, (also shown and marked in FIG. 6). When all six seating elements 18 are deployed outwardly, a maximum width is obtained, the drain catch 10 can be placed into the sink drain 76 until the drain catch 10 flange 12 rests firmly over the sealing flange 68.

Referring now specifically to FIG. 9, attaching the drain catch 10 is not in plumbing drain 76, it is shown how to remove the drain catch 10 from the plumbing drain 76 by inserting into one of the six ovoid 16 a blade 73 of a screwdriver 72 or other lever, and prying the drain catch 10 in an upward direction marked "u" by rotating the handle 73 in a downward direction with a force "F". This would permit the drain catch 10 to be removed and cleaned of hair and other items which may be blocking the flow of water into the plumbing drain 76 which have been caught by the restriction within drain catch 10 such as bars 90 and 92, and then when cleared, drain catch 10 can be reinserted to plumbing drain 76.

Figure 10:
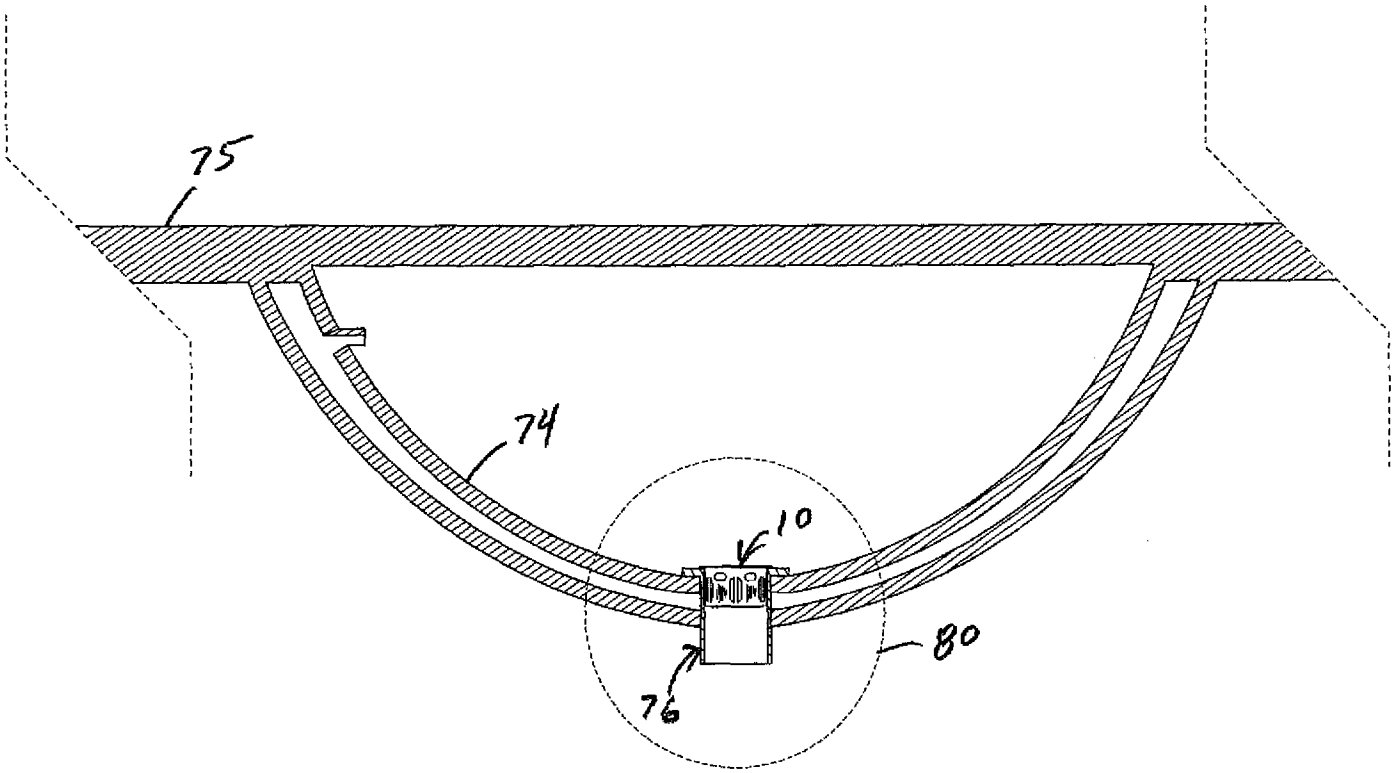
FIG. 10 is a cut-away view of a sink with the drain catch insert into the plumbing drain.

Referring now specifically to FIG. 10, sink 74 is shown depending from a sink table 75. The drain catch 10 is shown inserted into the plumbing drain 76 of the sink 74. The dashed lines 80 will show an exploded view of the plumbing drain 76 and the drain catch 10 at FIG. 11.

Figure 11:
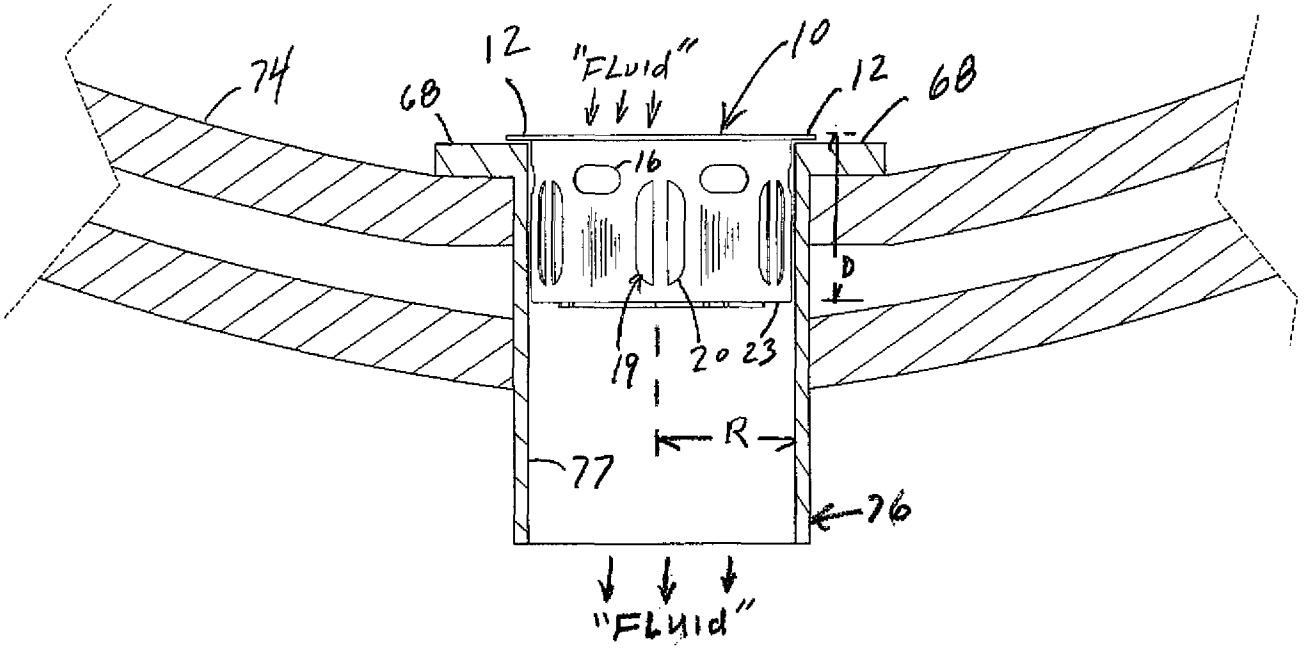
FIG. 11 is an exploded view of the dashed line portion of FIG. 10 showing a close up of that portion of the sink after the drain catch has been fitted into the plumbing drain.

Referring now to FIG. 11, an exploded view of the interior of the dashed lines 80 of FIG. 10 is shown. The drain catch 10 is shown in an inserted position in the plumbing drain.76. The flange 12 of the repair insert 10 is shown abutting sealing flange 68. The oval cutouts 16 for the removal of the drain cross bar repair insert 10 are shown below the flange 12. Below the oval cutouts 16 are the sizing elements 19. Each of the sizing elements 19 include a seating element 18 intermediate a right side crescent shaped cutout 20 and a left side crescent shaped cutout 22. Although not shown in FIG. 11, a seating element 18 may have been deformed outwardly away from external surface 17 by a screwdriver 72 or the like, and the cylindrical wall 14 of the drain catch 10 and/or the seating elements 18 contract the internal surface 77 of the plumbing drain 76. The drain catch 10 fits into the drain 76 of the sink 74 a distance "D," the height of the drain catch 10. The external surface 17 of drain catch 10 is adjacent the internal surface 77 of plumbing drain 76. The drain catch 10 fits into the drain 76 a distance "D" as seen in FIG. 10; however, it is not limited to such a distance. The letter "R" represents the radius of the drain catch 10. This radius "R" is not limited to the radius "R" in this view. The radius "R" can be selected to be an appropriate distance which would permit the drain catch 10 to accommodate the diameter of different sized drains 76 and which can be adjusted by the outward displacement of one or more of the seating element 18. As seen in FIG. 11, the direction of "fluid" not shown but contained within sink 74 is from sink 74, drain catch 10 and through the inner channel of plumbing drain 76.

While the invention has been described in its preferred form or embodiment with some degree of particularity, it is understood that this description has been given only by way of example and that numerous changes in the details of construction, sizes, fabrication, and use, including the combination and arrangement of parts, may be made without departing from the spirit and scope of the invention.

I claim:

1. A drain catch for receiving a fluid in a plumbing drain comprising:

a drain body having a cylindrical wall constructed and arranged for having a fluid flow therethrough;

said drain body having a first end and a second end;

said cylindrical wall having an internal surface defining an inner channel and an external surface;

said first end of said drain body having a flange extending from said cylindrical wall for supporting said drain body on a plumbing drain;

said second end of said drain body having one or more elongated bars extending from said internal surface of said cylindrical wall into said inner channel;

at least one seating element defined by said cylindrical wall;

said seating element configured for engaging an inner diameter of a drain and holding the drain catch in place;

said seating element having one or more cutouts within said cylindrical wall adjacent said seating element;

said seating element is defined by a first cutout adjacent one side of said seating element and a second cutout adjacent a second side of said seating element;

said first cutout and said second cutout are congruent;

said seating element extends in a direction from said first end to said second end;

said seating element is displaced beyond said external surface;

a plurality of lift openings within said cylindrical wall spaced apart from one another in close proximity to said first end of said cylindrical wall;

wherein said lift openings are generally oval, and wherein edges of said bars have flanges depending therefrom.

2. A method for inserting a drain catch into a plumbing drain comprising:

a drain body having a cylindrical wall constructed and arranged for having a fluid flow therethrough;

said drain body having a first end and a second end;

said cylindrical wall having an internal surface defining an inner channel and an external surface;

said first end of said drain body having a flange extending from said cylindrical wall for supporting said drain body on a plumbing drain;

said second end of said drain body having one or more elongated bars extending from said internal surface of said cylindrical wall into said inner channel;

at least one seating element defined by said cylindrical wall;

said seating element configured for engaging an inner diameter of a drain and holding the drain catch in place;

said seating element having one or more cutouts within said cylindrical wall adjacent said seating element;

said seating element is defined by a first cutout adjacent one side of said seating element and a second cutout adjacent a second side of said seating element;

said first cutout and said second cutout are congruent;

said seating element extends in a direction from said first end to said second end;

said seating element is displaced beyond said external surface;

determining if the outside diameter of the cylindrical wall is less than the inside diameter of the plumbing drain;

displacing one or more of said seating elements beyond said external surface; and inserting said drain catch into said plumbing drain such that one or more of said seating elements are in contact with the inner surface of said plumbing drain.

3. The method for inserting a drain catch according to claim 2 wherein said drain catch has a plurality of lift openings within said cylindrical wall spaced apart from one another in close proximity to said first end of said cylindrical wall;

inserting an end of a lever into one of said lift openings; and pushing said lever to lift said drain catch from said plumbing drain.

* * * * *